United States Patent [19]

Anton

[11] 4,320,177

[45] Mar. 16, 1982

[54] ELECTRICALLY CONDUCTIVE PART WITH AN INSULATION MATERIAL WHICH WITHSTANDS HIGH TEMPERATURES AND A METHOD OF MANUFACTURING SUCH A PART

[75] Inventor: Alain Anton, Chaponnay, France

[73] Assignee: Societe Anonyme dite: Alsthom-Atlantique, Paris, France

[21] Appl. No.: 96,124

[22] Filed: Nov. 20, 1979

[30] Foreign Application Priority Data

Nov. 24, 1979 [FR] France ..... 78 33182

[51] Int. Cl.[3] ..... C23C 5/00

[52] U.S. Cl. ..... 428/675; 72/38; 72/47; 72/700

[58] Field of Search ..... 72/38, 46, 47, 700; 428/674, 626, 675; 148/11.5 Q, 11.5 C

[56] References Cited

U.S. PATENT DOCUMENTS

| | | | |
|---|---|---|---|
| 3,097,965 | 7/1963 | Wilkins | 428/674 X |
| 3,238,025 | 3/1966 | Pendleton et al. | 428/674 X |
| 3,381,364 | 5/1968 | Winter | 428/674 X |
| 3,537,493 | 11/1970 | Hagarman et al. | 148/11.5 Q |
| 3,729,294 | 4/1973 | Hibbs, Jr. | 428/674 X |
| 3,967,013 | 6/1976 | Danis | 428/674 X |
| 3,969,155 | 7/1976 | McKeighen | 72/38 X |

*Primary Examiner*—Frank T. Yost

*Attorney, Agent, or Firm*—Sughrue, Mion, Zinn, Macpeak and Seas

[57] ABSTRACT

An electrically conductive part with an insulation material which withstands high temperatures and a method of manufacturing such a part. Its conductive core is formed by drawing a copper billet coated with a copper-aluminium alloy.

3 Claims, No Drawings

ELECTRICALLY CONDUCTIVE PART WITH AN INSULATION MATERIAL WHICH WITHSTANDS HIGH TEMPERATURES AND A METHOD OF MANUFACTURING SUCH A PART

FIELD OF THE INVENTION

The present invention relates to an electrically conductive part whose insulation material withstands high temperatures and a method of manufacturing such a conductive part and in particular an electric conductor of this type and a method of manufacturing it.

BACKGROUND OF THE INVENTION

There have already been described electric conductors for withstanding high temperatures, said conductors being constituted by wires of metal (generally copper), which is a good conductor, coated with nickel or gold, for example, to which an enamel made of a heat resistant synthetic resin is applied. When the conductor is made of copper not coated with another metal, since insulating enamels are often partially porous to air, an oxide layer forms as soon as the temperature rises above 250° C. Said oxide layer considerably reduces the adherence of the enamel on the conductor. This is detrimental to the thermal conduction phenomenon and to the mechanical strength of the insulation assembly. There is also an interface between the copper and the protective metal where phenomena of diffusion of one metal into the other occur. This reduces the effectiveness of the protection. Lastly, in the case of conductors intended for high-frequency current, since the superficial electric conductivity of the protective metal is higher than that of copper, the current is even more concentrated at the surface of the conductor and causes extra heating of the enamel.

SUMMARY OF THE INVENTION

The present invention aims to provide an electrically conductive part with an insulation material which withstands temperatures higher than 250° C. for long periods, i.e. of about a few tens of thousands of hours, said insulating material even withstanding temperatures of 400° to 500° C. for some time, the covering enamel then being judiciously chosen from among those which withstand such temperatures, such as thermostable heterocyclic polymers or organo-inorganic polymers.

The electrically conductive part according to the invention is characterized in that its conductive core is formed by drawing a copper billet coated with a copper-aluminium alloy. Such billets are known, but they have not been used up till now for manufacturing electric conductors.

The method of manufacturing the conductive part is characterized in that its conductive core is prepared by subjecting a copper billet coated with a copper-aluminium alloy to one or several hot-drawing operations to reduce its diameter to at least a value lying between 50 and 80 mm, followed by a series of cold-drawing operations with lubrication.

Preferably annealing in a vacuum or in inert gas is carried out between some cold-drawing operations.

EXAMPLE

By way of example, starting with a copper billet 80 mm in diameter with a surface layer of 10 mm of a copper-aluminium alloy obtained by diffusion in a vacuum and surface truing a first hot wire-drawing operation is effected at 700° to 750° C. to bring the diameter to between 13 and 8 mm.

Starting with drawn rods which are 8 mm in diameter, a wire of 0.8 mm diameter is obtained by cold drawing in 15 to 20 runs, while lubricating with a thick oil such as Anterol "TCH 1" manufactured by Trefimetaux and constituted by a mixture of polymerized hydrocarbon and of esters of fatty acids. To avoid any hardening of the surface layer of copper-aluminium alloy, it is necessary between some of the cold-drawing operations to anneal in a vacuum or under an inert gas at a temperature between 650° and 750° C., the annealing temperature and time being a function of the diameter of the rod or of the wire.

Such a type of conductor with a diameter of 0.8 mm has a surface electric conductivity close to that of copper (1.941 mho-cm$^2$/cm as compared with 1.724 mho-cm$^2$/cm). It is oxidised only from 600° C. with a saturation phenomenon. It can be used in rotating machines for 20,000 hours at 250° C.

Although the conductor and the method of manufacturing it such as described by way of example correspond to the preferred variant of the invention, it will be understood that various modifications can be made thereto without going beyond the scope of the invention, it being possible to replace some operations of the manufacturing method by others which would perform an analogous technical function. In particular, it is possible to start from a billet with a thicker or thinner layer of copper-aluminium alloy than that mentioned. Hot-drawing can be effected up to a diameter of less than 50 mm. In the same way, strap-braided conductors can be manufactured. Also, the same method can be used to manufacture all conductive parts which can be used in the electrical industry, such as collector strips for rotating machines, copper rods for alternators, stators or rotors of rotating machines.

I claim:

1. In an electrically conductive article comprising a conductive core part and an insulation material surrounding said core part and being capable of withstanding high temperatures, the improvement wherein said conductive core part comprises a drawn down copper billet having a coating of a copper-aluminum alloy for protecting it against high temperature oxidation, and wherein said core part is manufactured by subjecting said copper billet coated with a copper-aluminum alloy to at least one hot drawing operation to reduce its diameter to a diameter between 13 and 8 mm, followed by a series of cold drawing operations with lubrication.

2. A method of manufacturing an electrically conductive article comprising a conductive core part and an insulation material capable of withstanding high temperatures, said method comprising the steps of:

subjecting a copper billet coated with a copper-aluminum alloy to at least one hot drawing operation to reduce its diameter to a value between 13 and 8 mm, followed by a series of cold drawing operations with lubrication to thereby provide a copper-aluminum coating protective against high temperature oxidation, and providing around said conductive core part bearing said copper-aluminum coating, an insulation material capable of withstanding high temperatures.

3. The method as claimed in claim 2, wherein said hot drawing operation is carried on at a temperature of between 700° and 750° C.

* * * * *